US006396449B1

(12) United States Patent
Osterhues et al.

(10) Patent No.: US 6,396,449 B1
(45) Date of Patent: May 28, 2002

(54) LAYERED ELECTRONICALLY SCANNED ANTENNA AND METHOD THEREFOR

(75) Inventors: Gordon D. Osterhues, Irvine, CA (US); Michael C. Miller, Chandler; Neal Eugene Tornberg, Mesa, both of AZ (US); Douglas K. Waineo, Placentia, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/809,129

(22) Filed: Mar. 15, 2001

(51) Int. Cl.[7] ..... H01Q 19/06

(52) U.S. Cl. ..... 343/754; 343/755; 343/756; 343/797

(58) Field of Search ..... 343/754, 756, 343/700 MS, 755, 795, 797, 853, 876, 909; 342/373, 374, 375

(56) References Cited

U.S. PATENT DOCUMENTS

| | | | | | |
|---|---|---|---|---|---|
| 4,266,203 | A | * | 5/1981 | Saudreau et al. | 343/786 |
| 4,298,878 | A | | 11/1981 | Dupressoir et al. | 343/795 |
| 4,514,734 | A | | 4/1985 | Cermignani et al. | 343/708 |
| 4,772,890 | A | * | 9/1988 | Bowen et al. | 343/756 |
| 4,905,014 | A | | 2/1990 | Gonzalez et al. | 343/909 |
| 5,081,466 | A | | 1/1992 | Bitter, Jr. | 343/767 |
| 5,182,496 | A | | 1/1993 | Manheimer et al. | 315/111.41 |
| 5,337,058 | A | * | 8/1994 | Cross | 343/756 |
| 5,686,928 | A | | 11/1997 | Pritchett et al. | 343/711 |
| 5,835,062 | A | | 11/1998 | Heckaman et al. | 343/700 MS |
| 5,864,322 | A | | 1/1999 | Pollon et al. | 343/909 |
| 5,923,302 | A | | 7/1999 | Waterman et al. | 343/846 |
| 5,959,594 | A | * | 9/1999 | Wu et al. | 343/909 |
| 6,037,911 | A | | 3/2000 | Brankovic et al. | 343/795 |
| 6,218,978 | B1 | * | 4/2001 | Simpkin et al. | 343/756 |

* cited by examiner

*Primary Examiner*—Tan Ho
(74) *Attorney, Agent, or Firm*—Harness Dickey & Pierce P.L.C.

(57) ABSTRACT

A layered, electronically scanned antenna. The antenna includes a plurality or array layers separated by dielectric spacers. Each array layer includes a transistor switched grid formed by a plurality of reflective/transmissive elements such as cross dipoles interconnected by a plurality of semiconductors, such as MOSFETs. When the switched grid is in an open state, its associated array layer is reflective. When it is in a closed condition, its associated layer is in a transmissive state. By controlling the state of each array layer, a desired degree of phase shift can be imparted to the signal reflected by the antenna. The antenna thus eliminates the need for costly MEMS/MMIC technology to achieve the desired degrees of phase shift of a signal reflected by the antenna.

20 Claims, 4 Drawing Sheets

| Layer State | Attenuation (dB) | Phase (Degrees) | Inter-Phase (Degrees) | Rel To Face (Degrees) |
|---|---|---|---|---|
| RTTT | -0.01 | 161 | | 0 |
| TRTT | -0.08 | 56 | 105 | -105 |
| TTRT | -0.16 | -36 | 92 | -197 |
| TTTR | -0.18 | -115 | 80 | -276 |
| Average | -0.11 | | 92 | |

LAYERED ELECTRONICALLY SCANNED ANTENNA AND METHOD THEREFOR

FIELD OF THE INVENTION

This invention relates to antennas, and more particularly to an electronically scanned antenna incorporating a plurality of radiating elements which form the antenna, and which each incorporate a plurality of layers of switchable devices for providing a requisite degree of phase shift to an electromagnetic signal received and reflected from each radiating element in order to form a beam and to point it in a desired direction.

BACKGROUND OF THE INVENTION

Radar and communication systems require antennas to transmit and receive electromagnetic (EM) signals, generally in the microwave or millimeterwave spectrum. One class of antennas is the electronically scanned antenna (ESA). In an ESA, the signal is transmitted and received through individual radiating elements distributed uniformly across the face of the antenna. Phase shifters in series with each radiating element create a well-formed, narrow, pencil beam and tilt its phase front in the desired direction (i.e., "scan" the beam). A computer electronically controls the phase shifters. ESAs offer fast scan speeds and solid state reliability.

While ESAs have proven effective in many applications, the main deterrent to their widespread application is their high cost. Another drawback is that ESAs have higher insertion losses associated with their phase shifters than mechanically scanned antennas. These losses increase the output power required of the transmitter of the ESA, which in turn increases its cost, power supply requirements and thermal management due to the increased power dissipation.

One approach to overcome the loss issue mentioned above is the use of an active ESA (AESA). The AESA is constructed by pairing amplifiers with phase shifters in the antenna. An AESA incorporates a power amplifier to provide the requisite transmitted power, a low noise amplifier to provide the requisite receiver sensitivity and a circulator connecting the transmit and receive channels to the radiating element. This approach is viable for small arrays, i.e., arrays of a few hundred elements. However, for a given antenna size, the number of radiating elements increases as the square of the frequency. Thus, for a high gain, millimeter wave antenna, the array often contains thousands of elements. In this instance, cost, packaging, control, power distribution and thermal management issues become significantly important concerns.

Space fed configurations using a passive ESA (PESA) promise to be less expensive than active ESAs for millimeter wave applications. A passive ESA does not use distributed amplifiers, but instead relies on a single high power transmitter and a low loss antenna. The reason for the lower cost is the simpler architecture of such an antenna that has fewer, less expensive parts. A PESA can be implemented in a number of quasi-optic configurations such as a focal point or off-set J-feed reflection antenna, as a transmission lens antenna, as a reflection Cassegrain antenna, or as a polarization twist reflection Cassegrain antenna. However, since PESAs do not have amplifiers to overcome the circuit losses, these losses, and particularly the phase shifter loss, become a key issue.

An approach to reduce phase shifter insertion loss is to implement the phase shifter with a micro-electromechanical system (MEMS) switch. The MEMS switch can be employed as the control device in various types of phase shifter designs. Since it is an electromechanical switch, it offers low insertion loss. A microwave monolithic integrated circuit (MMIC) of MEMS-based phase shifters and radiators can be fabricated as a subarray. This scale of integration promises lower costs. However, MEMS based MMIC phase shifters remain expensive and their integration into a full array will be even more costly for a millimeter wave antenna. They are also relatively fragile compared to solid state devices and require high control voltages, for example, about 70 Volts. For some configurations, packaging the phase shifter and radiator(s) in the requisite cell area, the maximum area that a radiating element can occupy for proper operation over a given maximum frequency and scan angle, is also difficult.

In view of the foregoing, it is a principal object of the present invention to provide a simpler, less lossy, more cost-effective solution for an ESA requiring large pluralities of radiating elements.

More particularly, it is a principal object of the present invention to provide an ESA in which the entire antenna aperture can be fabricated and assembled at the wafer level.

SUMMARY OF THE INVENTION

The above and other objects are provided by a layered electronically scanned antenna (LESA) and method in accordance with the preferred embodiments of the present invention. The LESA is structured as two or more layers of thin wafers consisting of uniformly distributed cells of solid-state components and separated by dielectric spacers. The size and pattern of the distribution is determined by known antenna array theory. The components of each layer are coincident with each other so that the cells on each layer form an array element of the antenna. Each component can operate either as a reflective cell or as a transmissive cell. Each reflective/transmissive component consists of a plurality of switch devices that control whether the cell assumes a reflective or transmissive state. The dielectric spacers between the wafer layers each have a predetermined electrical thickness that, together with the wafer layer, provides a desired degree of spatial phase shift to an electromagnetic wave passing therethrough. In one preferred embodiment each spacer has an electrical thickness of 45°. Thus, an electromagnetic wave passing through the wafer layer and spacer and being reflected back through the spacer and wafer layer by a reflective component undergoes a 90° phase shift referenced to the face of the array. A control circuit controls the switch devices within the components such that the components of each cell at each layer are made to be either reflective or transmissive to thus achieve the desired degrees of phase shift of the signal radiating from each array element. Again by known antenna array theory, the distribution of phase settings across the array can be determined to form and point the beam of the radiated signal to a given direction. Additionally, if the main reflector that contains the array is flat, then the phase shift of each array element can be set to provide an electrical parabolic shape in order to properly focus the beam.

In one preferred embodiment, each array element includes three wafer layers separated by three dielectric spacers each having an electrical thickness of 45°. A fourth layer is included which is strictly a reflective layer, typically a metal sheet (ground plane). If a cell on the first layer is in a reflective state, then the signal incident thereon is reflected with a given phase that establishes the reference or zero phase state at the face of the array. If the cell on the first layer is in a transmissive state, then the electromagnetic signal passes therethrough, through the first spacer and impinges on the cell on the second layer directly beneath the cell on the first layer. If the cell on the second layer is in the reflective state, then the electromagnetic signal is reflected therefrom back through the first spacer and the first layer to provide a phase shift of 90° with respect to the face of the array. If the cells on the first and second layers are both in the transmissive state, and if the cell in the third layer is in the reflective state, then a phase shift of 180° will be imparted to the signal reflected therefrom as the signal makes two passes through the two layers and spacers. If the cells on all three layers are in the transmissive state, then the signal is reflected by the ground plane back through the three spacers and layers to provide a phase shift of 270°.

The LESA of the present invention can be implemented in a wide variety of configurations including focal point or off-set J-feed, reflection Cassegrain, polarization twist reflection Cassegrain and other known antenna configurations. The reflective/transmissive components can be formed by a group of resonant dipoles, resonant cross dipoles (cruciforms) or other components that fit within a cell and provide a reflective surface at the operating frequency when disconnected from each other and a transmissive surface when connected to each other.

The present invention thus constructs an affordable millimeter wave ESA employing wafer level fabrication and assembly. It enables an ESA to be constructed without the need for MEMS switches to achieve low insertion loss at millimeter wave frequencies. However, the invention does not preclude their use or the use of any other type of switch. It further provides for a reliable, solid-state ESA that can be driven by low voltage CMOS control circuitry.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
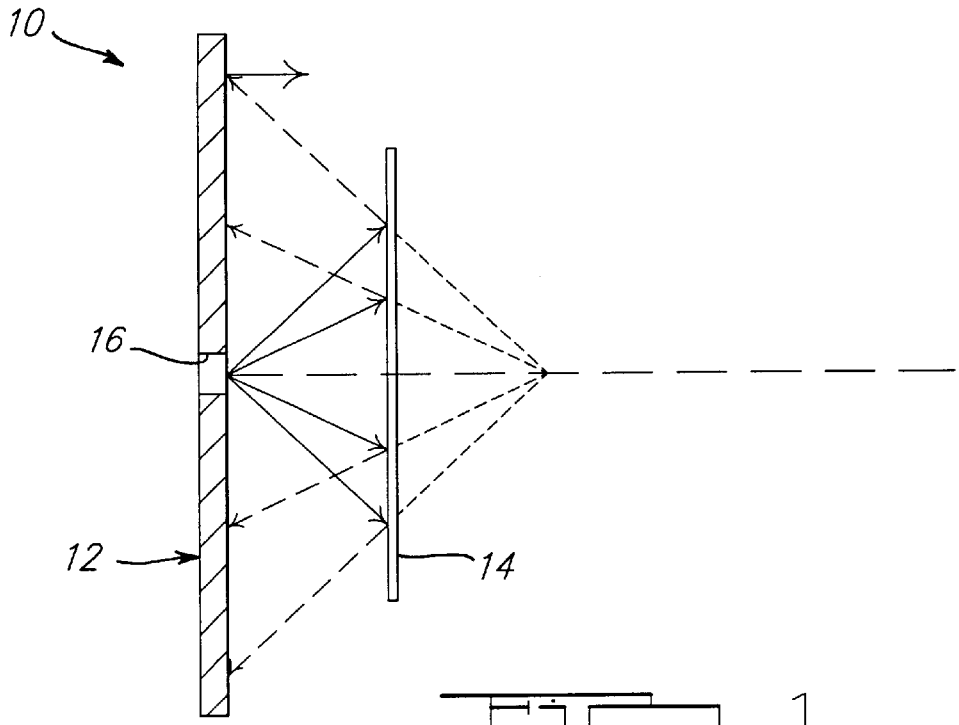
FIG. 1 is a simplified side view of a layered electronically scanned antenna in accordance with a preferred embodiment, wherein the antenna is illustrated in the configuration of a Cassegrain antenna.

Referring to FIG. 1, there is shown an antenna 10 in accordance with a preferred embodiment of the present invention. The antenna 10 is shown in the form of Cassegrain antenna, but it will be appreciated immediately that the present invention is just as readily adaptable to various other quasi-optic antenna configurations such as focal point or off-set J-feed, a polarization twist Cassegrain, as a transmission lens, or in other configurations. Also, the surfaces of the main reflector and subreflector may have parabolic shapes, hyperbolic shapes or flat shapes.

The antenna 10 includes an array 12 spaced apart from a subreflector 14. A feed aperture 16 allows a polarized signal to be directed at the subreflector 14, which is then reflected by the subreflector 14 back to the main reflector that includes the array 12. A desired phase shift is imparted to the signal by the array 12 and the signal is reflected back toward the subreflector 14 and radiates into space. A polarization twist Cassegrain mitigates the blockage of the subreflector. Such a configuration requires a polarization sensitive subreflector and the insertion of a circular polorizer in front of the main reflector and below the output of the feed horn. These are refinements, however, that are not germane to the present invention.

Figure 2:
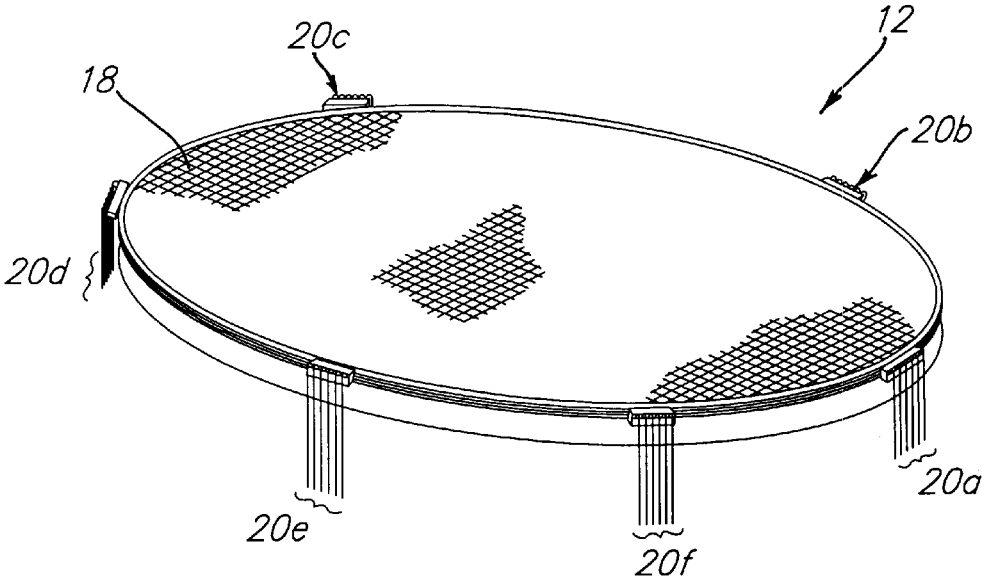
FIG. 2 is a perspective view of the array shown in FIG. 1.

FIG. 2 illustrates the array 12 in greater detail. The array 12 may vary significantly in dimensions but in one preferred form comprises a disc many wavelengths in diameter. The array 12 is comprised of a large plurality of array elements 18 formed in cells positioned sufficiently close to one another on a layer so as to avoid grating lobes at the highest frequency and widest scan angle of operation. The array elements 18 each comprise a plurality of layers and a ground plane. The elements 18 are comprised of reflective/transmissive components consisting of nine cross dipoles (3×3 matrix) that are interconnected by transistor switches, which will be described in greater detail in the following paragraphs.

Referring to FIG. 2, the array elements 18 are electrically coupled to an electronic control circuit via a plurality of groups 20*a*–20*f* of control lines. Preferably radially opposing pairs of control lines 20*a*–20*f* are used to couple each layer of the antenna 12 to the control circuit to provide a means for transmitting electrical switching signals to the array elements 18 to achieve a desired degree of phase shifting of the signal transmitted from the array 12.

Figure 3:
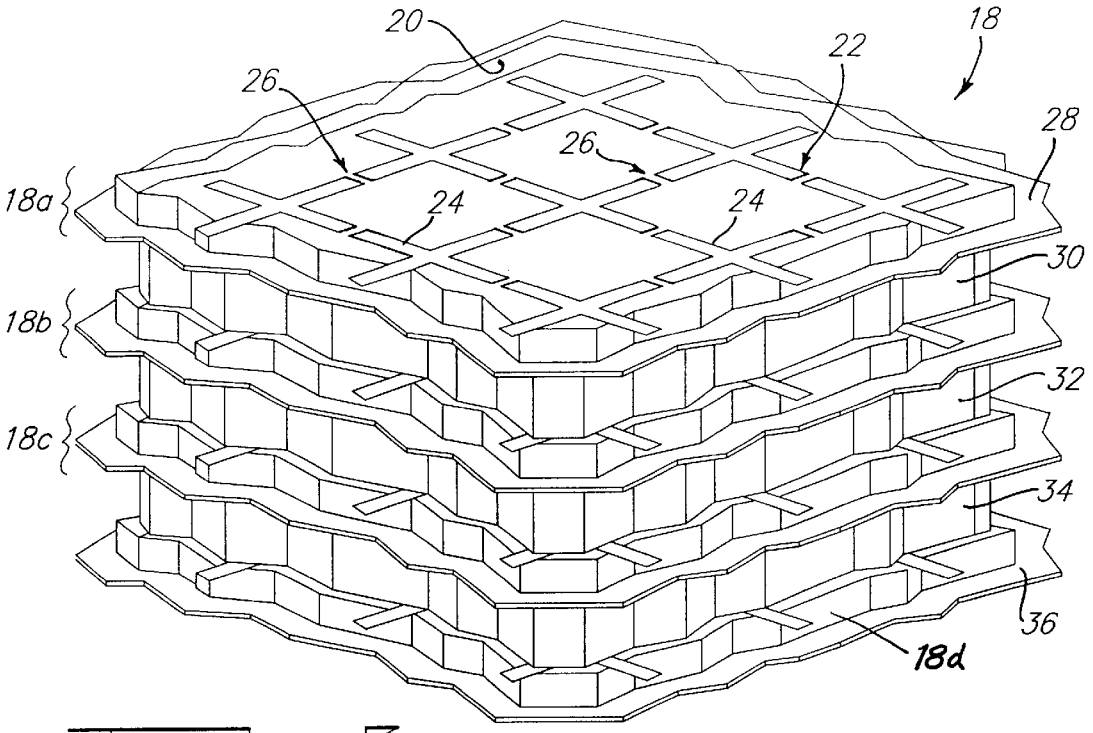
FIG. 3 is a highly enlarged, perspective view of one array element illustrating the layered configuration of cells to form an array element and the 3 by 3 matrix of cross dipoles (component) interconnected by transistor gates (devices) that control the reflective or transmissive state of the cell at each layer and thereby setting the phase of the antenna element.

Referring to FIG. 3, one array element 18 is shown in highly enlarged fashion. The array element 18 is formed by a plurality of layers of controllably reflective/transmissive components disposed closely adjacent one another. A first layer 18*a* includes an anti-reflective coating covering a switched grid 22 of interconnected cross dipoles and switches. The reflecting components are illustrated as resonant cross dipoles (cruciforms) 24, however it will be appreciated that resonant dipoles, or any other configuration that provides a reflective surface at the operating frequency could be incorporated.

The cross dipoles 24 are coupled by a plurality of switches 26, which in the preferred embodiment are MOSFET semiconductors. However, the invention is not restricted to MOSFET switches. Each array element 18 is comprised of nine cross dipoles 24 intercoupled by twelve MOSFETS 26. The switched grid 22, which may be referred to as a "transistor switched grid" (TSG), is preferably formed on a polyamide substrate 28. A first array layer 18*a* of the array element 18 is separated from a second, otherwise identical, array layer 18*b* by a first dielectric spacer 30 forming a boundary layer between the first array layer 18*a* and the second array layer 18*b*. The dielectric spacer 30 has a thickness of about one-eighth wavelength which provides an electrical "thickness" of about 45°. A third array layer 18*c* is separated from the second array layer 18*b* by a second dielectric spacer 32 which is identical in construction to first dielectric layer 28. The third array layer 18*c* is separated from a reflective layer 18*d* by a third dielectric spacer 34. A ground plane 36, which may comprise a thin layer of metal, is formed on the side of the third dielectric layer opposite that of the third array layer 18*c*. The conductors connected to each layer supply the address, data and supply voltages to switch the transistor gates open (reflective) or closed (transmissive) as illustrated in the control circuit block diagram of FIG. 4.

Figure 4:
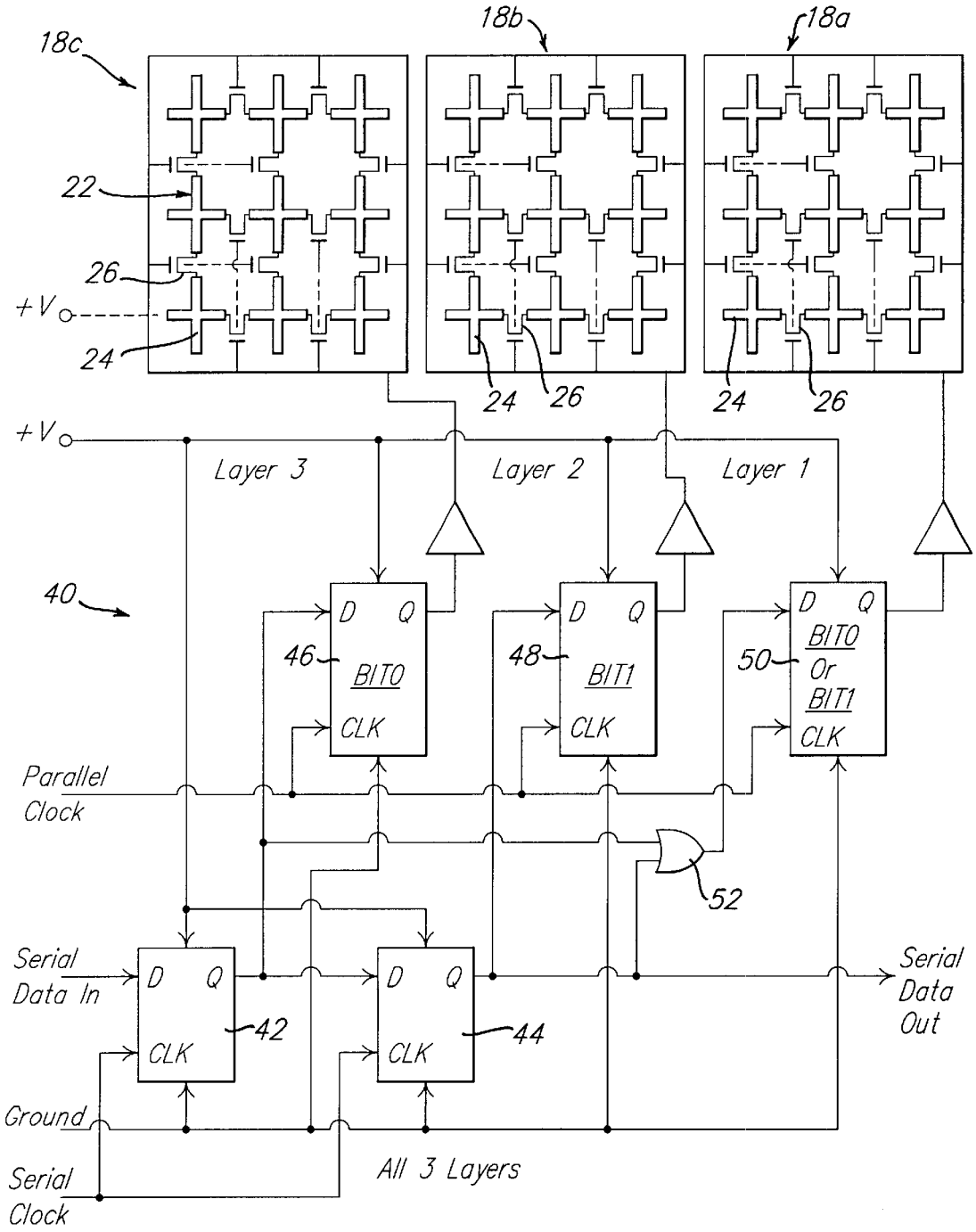
FIG. 4 is a simplified schematic drawing of a control circuit for controlling the switches associated with each cell.

With reference to FIG. 4, a control circuit 40 for controlling the TSG 22 of each array layer 18*a*, 18*b* and 18*c* is illustrated. The control circuit 40 incorporates a plurality of D-type flip-flops 42–50. Flip-flop 46 has its output coupled to the TSG 22 of array layer 18*c*. Flip-flop 48 has its output coupled to the second array layer 18*b*, and flip-flop 50 has its output coupled to the switched grid of array layer 18*a*. An OR-gate 52 receives outputs from the flip-flop 42 and the flip-flop 44, and provides an output to the "D" input of flip-flop 50. The output of flip-flop 44 is connected to the "D" input of flip-flop 48. The output of flip-flop 42 is connected to the "D" input of flip-flop 46 and the "D" input of flip-flop 44.

The logic states, either a 1 or a 0, of flip-flops 46, 48, and 50 are updated as a function of the logic states of flip-flops 42 and 44 at the time an appropriate transition (from positive to negative or negative to positive, depending on the detailed circuit design) on the "Parallel Clock" line occurs. At the time an appropriate transition on the "Parallel Clock" line occurs the states of flip-flops 42 and 44 represent a 2-bit control word that represents a phase shift of 0, 90, 180, or 270 degrees. The 2-bit control word is stored in flip-flops 42 and 44 after a serial data transfer from the "Serial Data In" connection to the "D" input of flip-flop 42. A predetermined number of serial data transfers takes place before the 2-bit control word corresponding to this phase shifter is in place (all other phase shifter control words will arrive at registers corresponding to their phase shifters at the same time).

Figure 5A:
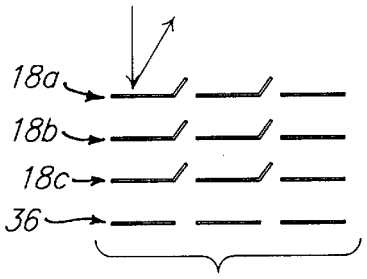
FIGS. 5*a*–5*d* illustrate the reflective/transmissive functions of the array elements in generating varying degrees of phase shift to a signal reflected from the array element.

Turning now to the operation of the antenna 10, reference will be made again to FIG. 3. When the MOSFETS 26 of TSG 22 of array layer 18*a* are open (i.e., non-conducting), the cross dipoles 24 are resonant and cause the first array layer 18*a* to assume a reflective condition. Accordingly, an electromagnetic wave "w" incident thereon is reflected by the cross dipoles 24 and sets the reference or zero phase shift value at the face of the array 12. This condition is illustrated in FIG. 5*a*.

Figure 5B:
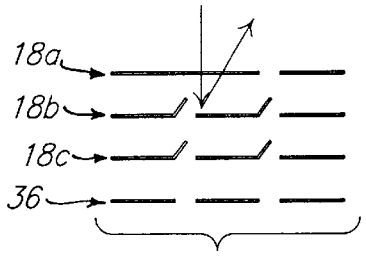

When the transistor TSG 22 of the first array layer 18*a* is closed, meaning that the MOSFETS 26 are conducting, the cross dipoles 24 are not resonant. The first array layer 18*a* is therefore transmissive and allows an electromagnetic signal impinging it to pass therethrough. The signal passes through the first dielectric spacer 30 and impinges the second array layer 18*b*. If the TSG 22 of the second array layer 18*b* is open, then layer 18*b* is in a reflective state and reflects the electromagnetic signal back through the first dielectric spacer 30 and through the first array layer 18*a*. As the signal passes through the first dielectric spacer 30 the first time a phase shift of 45° is imparted to the signal. As the reflected signal passes back through the first dielectric spacer 30 an additional 45° of phase shift is imparted to the signal for a total of 90° of phase shift. This condition is illustrated in FIG. 5*b*.

Figure 5C:
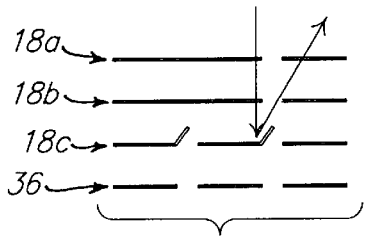

If the first and second array layers 18*a* and 18*b* are each in transmissive states, and if the TSG 22 of the third array layer 18*c* is open (i.e., conducting), then the signal received by the array element 18 passes through the first and second array layers 18*a* and 18*b* before being reflected by the third array layer 18*c*. The reflected signal passes through each of the first and second dielectric spacers 30 and 32 twice, thus providing a total phase shift of 180° to the reflected signal. This condition is illustrated in FIG. 5*c*.

Figure 5D:
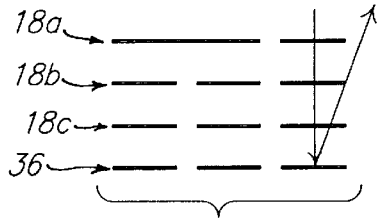

If the first, second and third array layers 18*a*, 18*b* and 18*c*, respectively, are all in transmissive states, meaning that the TSG 22 of each layer is in a closed (i.e., conducting) state, then the signal received by the array element 18 passes through each of these layers and is reflected by the reflective layer 18*d*. The total phase shift of this signal, as a result of passing through each of the three dielectric spacers 30, 32 and 34 twice, is 270°. This condition is illustrated in FIG. 5*d*. The following table summarizes these states with reference to the control circuit of FIG. 4.

| Bit 1 | Bit 0 | L1 | L2 | L3 | L4 | φ |
|---|---|---|---|---|---|---|
| 0 | 0 | R | X | X | R | 0 |
| 0 | 1 | T | R | X | R | 90 |
| 1 | 0 | T | T | R | R | 180 |
| 1 | 1 | T | T | T | R | 270 |

X = Don't Care
R = Reflect
T = Transmit
L1 = Layer 1 of array element 18
L2 = Layer 2 of array element 18
L3 = Layer 3 of array element 18

Thus, by controlling the TSG 22 of each array layer 18*a*, 18*b* and 18*c*, a desired degree of phase shift can be imparted by each array element 18 to the electromagnetic signal received thereon. Advantageously, this is accomplished without the need for any electromechanical phase shifters. The switchable, reflective array layers 18*a*, 18*b* and 18*c* and the low voltage control circuitry illustrated in FIG. 4 are preferably formed by encapsulating these elements on a wafer using Silicon-on-plastic technology. For a four layer (two bit) layered electronically scanned antenna, the wafer costs will be less than a Gallium Arsenide (GaAs) wafer used in MEMS/MMIC phase shifters. It is also more amenable to large wafer sizes that can accommodate an entire array in a single wafer. This construction promises to provide less complexity and less loss than MEMS/MMIC technology.

Figure 6:
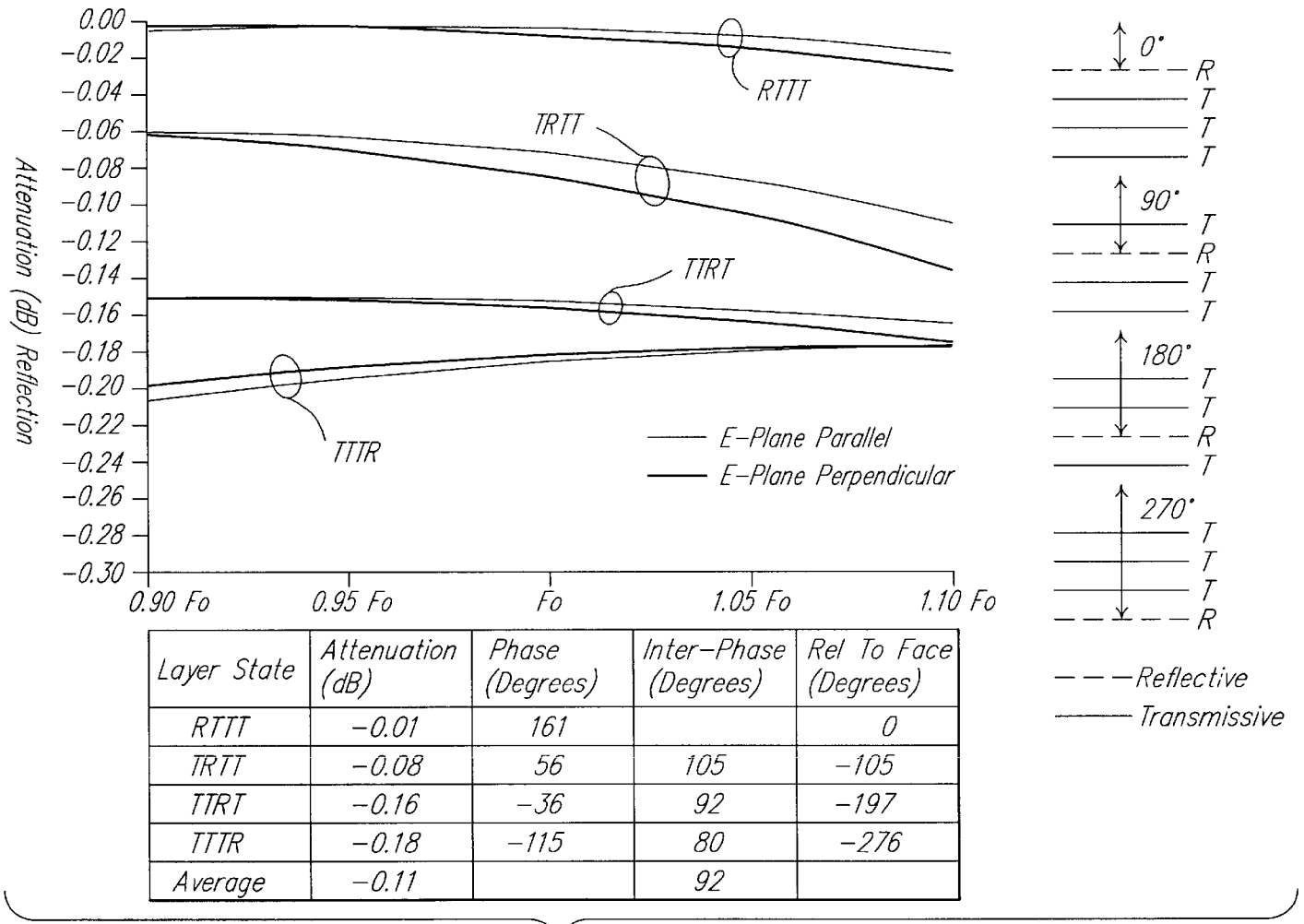
FIG. 6 is a graph showing the simulated loss of an infinite array of the four layer radiating element plotted for the four phase states as a function of frequency.

Referring to FIG. 6, the simulated loss of an infinite array of the four layer radiating element is plotted for the four phase states as a function of frequency. The frequency range is +/−10% of the center frequency. "TRTT" corresponds to the condition of the layers 18 as shown in FIG. 5*b*. "TTRT" corresponds to the condition shown in FIG. 5*c*. "TTTR" corresponds to the condition shown in FIG. 5*d*, and "RTTT" corresponds to the condition shown in FIG. 5*a*. The pair of lines for each phase state show the losses for the incident electric field being either parallel or perpendicular to the array surface. The accompanying table shows the numeric values for the insertion loss and the phase shift of the radiating element at the center frequency. These results show that the desired phase shift can be achieved with very little attenuation.

From the foregoing, it will be appreciated then that the antenna of the present invention allows a desired degree of phase shift to be imparted to a signal radiated from the antenna without the use of costly microelectromechanical phase shifting elements. By employing the "layered" array element approach described herein, a simple yet effective antenna is constructed which is capable of providing controlled degrees of phase shift to a beam radiated from the antenna. The antenna can further by constructed in a much more cost effective manner than antennas employing MEMS/MMIC technology and therefore could make the antenna of the present invention usable in many applications where present day electronically scanned antennas are too costly to employ.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An electronically scanned array antenna comprising:

a plurality of array elements each including a switch and a reflecting component responsive to said switch, wherein when the switch is in a closed state the reflecting component acts as a transmissive element to allow an electromagnetic wave to pass therethrough, and when said switch is in an open state said reflecting component acts to reflect an electromagnetic wave incident thereon;

said array elements being arranged in a first plane to form a first layer of said array elements;

a second layer forming a reflector;

a dielectric material disposed between said first and second layers, said dielectric material providing a predetermined degree of electrical phase shifting to an electromagnetic wave passing therethrough; and a control system for controlling said plurality of array elements to provide a desired degree of phase shift to a signal reflected from said antenna.

2. The antenna of claim 1, wherein when said switches of said plurality of array elements of said first layer are opened, an electromagnetic signal incident thereon is reflected from said first layer.

3. The antenna of claim 1, wherein each said switch comprises a transistor.

4. The antenna of claim 1, wherein each said reflecting component comprises a resonant dipole.

5. The antenna of claim 4, wherein each said resonant dipole comprises a resonant cross dipole.

6. The antenna of claim 1, wherein said dielectric material is selected to provide a phase shift of 45° to an electromagnetic wave passing therethrough.

7. An electronically scanned phased array antenna comprising:

a plurality of array elements each including a switch and a reflecting component responsive to said switch, wherein when the switch is in a closed state the reflecting component acts as a transmissive element to allow an electromagnetic wave to pass therethrough, and when said switch is in an open state said reflecting component acts to reflect an electromagnetic wave incident thereon;

a first subplurality of said array elements being arranged in a first layer;

a second subplurality of said array elements being arranged in a second layer disposed adjacent said first layer; and a dielectric material forming an intermediate layer disposed in between said first and second layers, said dielectric material providing a predetermined degree of phase shift to an electromagnetic signal passing through said first layer and reflected by said second layer when said array elements of said first layer are in a transmissive state and said array elements of said second layer are in a reflective state.

8. The antenna of claim 7, wherein each said switch comprises a transistor.

9. The antenna of claim 7, wherein each said reflecting component comprises a resonant dipole.

10. The antenna of claim 9, wherein each said resonant dipole comprises a resonant cross dipole.

11. The antenna of claim 7, wherein said dielectric material is selected to provide a phase shift of 45° to an electromagnetic wave passing therethrough.

12. The antenna of claim 7, further comprising:

a reflector forming a third layer;

a second dielectric material forming a second plane disposed in between said second layer and said third layer; and wherein said antenna provides a first degree of phase shifting to a received electromagnetic signal received when said array elements of said first layer are in a transmissive state and said array elements of said second layer are in a reflective state; and wherein said antenna provides a second degree of phase shifting to a received electromagnetic signal received when said array elements of said first and second layers are in a transmissive state and said electromagnetic signal is received on said third layer.

13. The antenna of claim 12, wherein said first dielectric material has an electrical thickness for providing a 45 degree phase shift to an electromagnetic signal passing therethrough.

14. The antenna of claim 12, wherein said second dielectric material has an electrical thickness for providing a 45 degree phase shift to an electromagnetic signal passing therethrough.

15. An electronically scanned phased array antenna comprising:

a plurality of array elements each including a plurality of switches and a plurality of reflecting components responsive to said switches, wherein when the switches are in an closed states their associated said reflecting components act as transmissive elements to allow an electromagnetic wave to pass therethrough, and when said switches are in open states said reflecting components act to reflect an electromagnetic wave incident thereon;

a subplurality of said array elements being arranged in a first plane forming a first layer;

a subplurality of said array elements being arranged in a second plane forming a second layer disposed adjacent said first layer;

a first dielectric layer of material disposed in between said first and second layers, said first dielectric layer of material providing a 90° phase shift to an electromagnetic signal passing through said first dielectric layer of material and reflected by said second layer back through said first dielectric layer of material when said array elements of said first layer are in a transmissive state and said array elements of said second layer are in a reflective state;

a subplurality of said array elements being arranged in a third plane forming a third layer disposed adjacent said second layer;

a second dielectric layer of material disposed in between said second and third layers, said second dielectric layer of material providing a 90° phase shift to an electromagnetic signal passing therethrough to said third plane and reflected by said third plane back through said second dielectric layer of material when said array elements of said third layer are in a reflective state;

a reflector layer disposed adjacent said third layer;

a third dielectric layer of material disposed in between said reflector layer and said third layer, said third dielectric layer of material providing a 90° phase shift to an electromagnetic signal passing therethrough to said reflector layer and reflected by said reflector layer back through said third dielectric layer; and wherein a cumulative phase shift of one of the group of 0°, 180°, and 270° is imparted to an electromagnetic signal received and reflected by said antenna by controlling said array elements of said first, second and third layers of array elements.

16. The antenna of claim 15, wherein each said array element comprises a dipole.

17. The antenna of claim 15, wherein each said array element comprises a cross dipole.

18. The antenna of claim 15, wherein said switch associated with each said array element comprises a transistor.

19. A method for forming an electronically scannable antenna, comprising the steps of:

using a first array layer comprised of a plurality of array elements, wherein each said array element controlled via electrical signals to assume a reflective state or a transmissive state, to receive an electromagnetic wave;

disposing a first dielectric substrate adjacent said first array layer, said substrate having a predetermined electrical thickness to provide a predetermined degree of phase shift to said electromagnetic wave when said electromagnetic wave passes therethrough; and using a reflector disposed adjacent said first dielectric substrate on a side of said substrate opposite to said first array layer, to receive said electromagnetic wave;

said antenna operating in a first state when said first array layer is in said reflective state to reflect said electromagnetic wave incident thereon without imparting any phase shift thereto; and said antenna operating in a second state when said first array layer is in the transmissive state to cause a predetermined degree of phase shift to be imparted to said electromagnetic wave when said wave passes through said dielectric substrate and is reflected back through said dielectric substrate by said reflector.

20. The method of claim 19, further comprising the steps of:

using a second array layer disposed in between said dielectric substrate and said reflector to receive said electromagnetic signal when said first array layer is in said transmissive state; and using a second dielectric disposed in between said second array layer and said reflector;

wherein said second array layer is controlled to assume a transmissive state or a reflective state; and using said second dielectric to impart an added degree of phase shift to said electromagnetic signal reflected by said reflector when said first and second array layers are both in said transmissive state.

* * * * *